United States Patent [19]

Denney

[11] 4,224,768

[45] Sep. 30, 1980

[54] APPARATUS FOR, AND METHOD OF, PLUNGE GRINDING

[75] Inventor: James J. Denney, Carmel, Ind.

[73] Assignee: The United States of America as represented by the Secretary of the Air Force, Washington, D.C.

[21] Appl. No.: 877,937

[22] Filed: Dec. 5, 1978

[51] Int. Cl.[3] ..... B24D 7/06; B24B 1/00

[52] U.S. Cl. ..... 51/209 R; 51/325

[58] Field of Search ..... 51/209 R, 325; 269/7

[56] References Cited

U.S. PATENT DOCUMENTS

| | | | |
|---|---|---|---|
| 1,743,604 | 1/1930 | Hoagland | 51/209 R |
| 1,868,492 | 7/1932 | Bucherster | 51/209 R |
| 2,063,492 | 12/1936 | DeLeeuw | 51/209 R X |
| 3,128,090 | 4/1964 | Andersen | 269/7 |
| 3,171,237 | 3/1965 | Howard | 51/209 R |
| 3,181,281 | 5/1965 | Hensley | 51/209 R |
| 3,672,032 | 6/1972 | Witherspoon | 269/7 X |

*Primary Examiner*—Gary L. Smith

*Attorney, Agent, or Firm*—Joseph E. Rusz; Arsen Tashjian

[57] ABSTRACT

An apparatus for, and a method of, forming annular grooves in a workpiece by plunge grinding. The preferred embodiment of the apparatus includes: a segmental grinding wheel chuck which further includes a circumferential chuck plate to which a plurality of arcuate-shaped, equally-spaced grinding wheel segment holders are releasably connected, and, grinding wheel segments that are removably attached, by and with the use of eutectic material, to the grinding wheel segment holders. The method sets forth the steps of removably attaching the grinding wheel segments for the holders with eutectic material.

2 Claims, 4 Drawing Figures

APPARATUS FOR, AND METHOD OF, PLUNGE GRINDING

STATEMENT OF GOVERNMENT INTEREST

The invention described herein may be manufactured and used by or for the Government for governmental purposes without the payment of any royalty thereon.

BACKGROUND OF THE INVENTION

This invention relates to the grinding art and, more particularly, to a unique method and apparatus (i.e., a segmented grinding wheel chuck using replaceable complementarily shaped grinding wheel segments) adapted for use in forming annular grooves, such as in vane segments for turbines, by plunge grinding (i.e., "infeed grinding").

It is well known in the art that the forming of annular grooves in workpieces, especially in the respective faces of segmented or segment-type workpieces, by prior art methods and apparatuses is time-consuming and difficult.

My novel method and apparatus minimize these inherent disadvantages; and, thereby, result in a significant advance in the state-of-the-art.

SUMMARY OF THE INVENTION

This invention pertains to a method of and apparatus for plunge grinding, with the method and the apparatus adapted for use in grinding annular grooves into the face of a workpiece, or into the faces of segmented constituent sections of a workpiece.

Accordingly, an object of this invention is to provide such an apparatus.

Obviously, another object of this invention is to provide such a method.

These objects, as well as other equally important and related objects, of this invention will become readily apparent after a consideration of the description of our invention and reference to the Figures of the drawings.

DESCRIPTION OF THE PREFERRED EMBODIMENT

Figure 1:
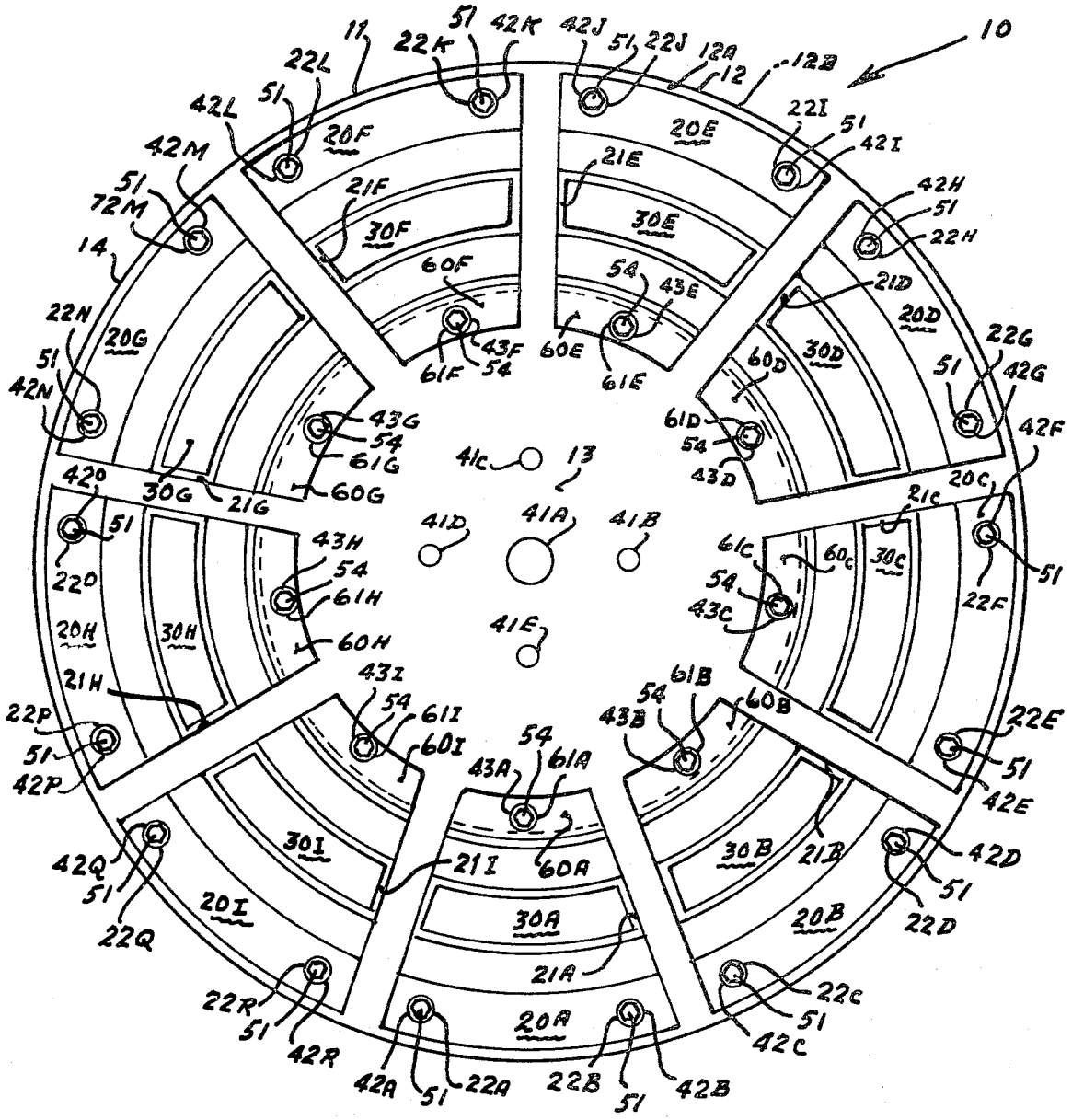
FIG. 1 is a top plan view, in simplified form, partially schematic and partially pictorial, of a preferred embodiment of the inventive apparatus.
Figure 2:
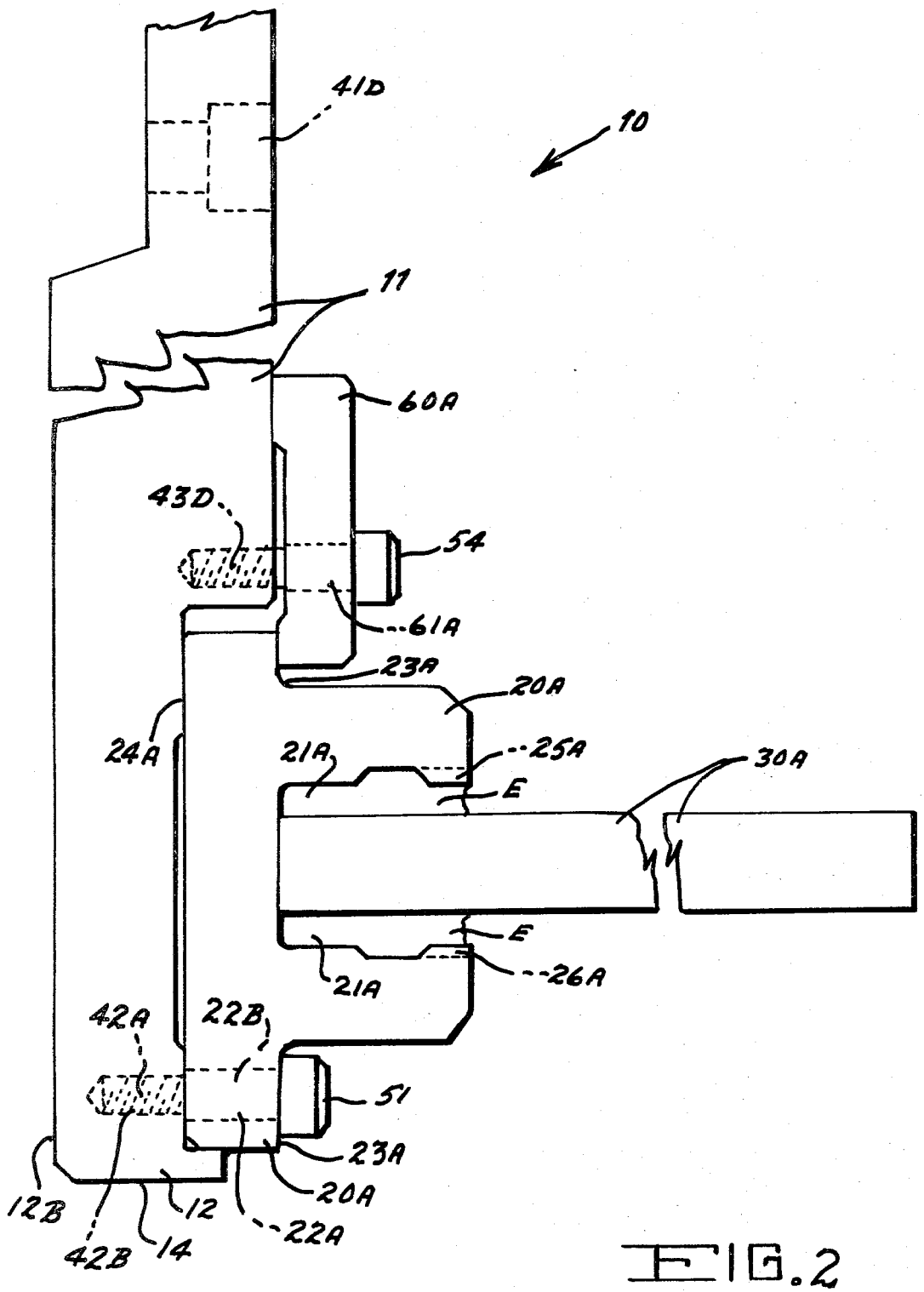
FIG. 2 is a side elevation view, also in simplified form, and also partially schematic and partially pictorial, of one representative portion, partially fragmented, of the preferred embodiment shown in FIG. 1.

With reference to FIGS. 1 and 2, therein is shown, in simplified form and in two views, the preferred embodiment 10 of my inventive apparatus.

In the most basic and generic structural form, the preferred embodiment 10 comprises a segmental grinding wheel chuck 11 to which are removably attached a plurality, preferably nine, of replaceable grinding wheel segments, such as 30A–30I, inclusive. More specifically, the segmental grinding wheel chuck 11 further comprises: a chuck plate 12 having a first surface 12A, a second surface 12B, a center portion 13, and a perimeter 14; and, a plurality, preferably nine, of identical arcuate-shaped grinding wheel segment holders, such as 20A–20I, inclusive, releasably connected, preferably in equally-spaced relationship, to the first surface 12A of the chuck plate 12, with each of the plurality of grinding wheel segment holders having an arcuate-shaped pocket therein, such as 21A for holder 20A (and 21B–21I, individually and respectively, for holders 20B–20I) that is limited and defined in part by turned-in edges (i.e., circumferential "grabbers"), such as 25A and 26A for holder 20A. The plurality of identical arcuate-shaped grinding wheel segments 30A–30I, with one grinding wheel segment for each one of the plurality of grinding wheel segment holders 20A–20I, such as grinding wheel segment 30A for holder 20A (and 30B–30I, respectively, for holders 20B–20I), are each positioned within a different one of the arcuate-shaped pockets 21A–21I (e.g., grinding wheel segment 30A is positioned in pocket 21A) and each grinding wheel segment is removably attached to its respective grinding wheel segment holder (e.g., grinding wheel segment 30A is removably attached to holder 20A) by, and with the use of, eutectic material, generally designated "E" in FIG. 2, preferably "cerro" metal, such as "Cerrotrue", that is readily available commercially.

The chuck plate 12 has a first plurality of openings, preferably five, designated 41A–41E, and a second plurality of openings, preferably eighteen, designated 42A–42R, and also a third plurality of openings, preferably nine, designated 43A–43I, in the first surface 12A of the chuck plate 12. The first plurality of openings 41A–41E is located at the center portion 13 of the chuck plate 12, and each of these openings passes through the plate 12 and its second surface 12B. These openings 41A–41E are for use in mounting the preferred embodiment 10 (and any variation thereof) to an appropriate fixture (not shown) for rotating and otherwise selectively moving the embodiment 10 during plunge grinding operations. The second plurality of openings 42A–42R is located inward of the perimeter 14 of the plate 12, and the purpose of these openings is for use in releasably connecting the plurality of grinding wheel segment holders 20A–20I to the plate 12. The third plurality of openings 43A–43I is located inward of the second plurality of openings 42A–42R, and the purpose of these openings in this embodiment 10 is also for use, in cooperation with other components, in releasably connecting the plurality of grinding wheel segment holders 20A–20I to the plate 12.

As a related matter, the grinding wheel segment holders 20A–20I have a fourth plurality of openings, preferably eighteen (i.e., two per holder), designated 22A–22R, in and through the holders 20A–20I.

In this embodiment 10, the plurality of identical arcuate-shaped grinding wheel segment holders 20A–20I are releasably connected to the first surface 12A of the chuck plate 12 by means (not numerically referenced, to prevent encumbering of the drawings) which include: a first plurality of fasteners, each of which is similarly designated 51, passing into and through the fourth plurality of openings 22A–22R in the holders 20A–20I, with these fasteners 51 passing into and accepted by the second plurality of openings 42A–42R in the chuck plate 12; a plurality of clamps, preferably nine (i.e., one for each holder 20A–20I), designated 60A–60I, having a seventh plurality of openings, preferably nine (i.e., one opening per clamp),designated 61A–61I, in and through the clamps 60A–60I; and, a fourth plurality of fasteners, each of which is similarly designated 54, passing into and through the seventh plurality of openings 61A–61I in clamps 60A–60I, and also simultaneously passing into and accepted by the third plurality of openings 43A–43E in the chuck plate 12.

It is here to be noted that as a matter of preference, rather than of limitation, the chuck plate 12 is in the geometric form of a right circular cylinder, with the first surface 12A and the second surface 12B defining the circular bases of the cylinder 12, and with the perimeter 14 of the chuck plate 12 simultaneously defining the circumferences of both of the bases (defined by the first and second surfaces 12A and 12B). Additionally, each of the plurality of arcuate-shaped grinding wheel segment holders 20A–20I has a first surface 23A–23I, respectively, and a second surface 24A–24I, respectively, with the second surfaces 24A–24I of the holders 20A–20I in abutting contact with the first surface 12A of the chuck plate 12.

DESCRIPTION OF THE VARIATION

Figure 3:
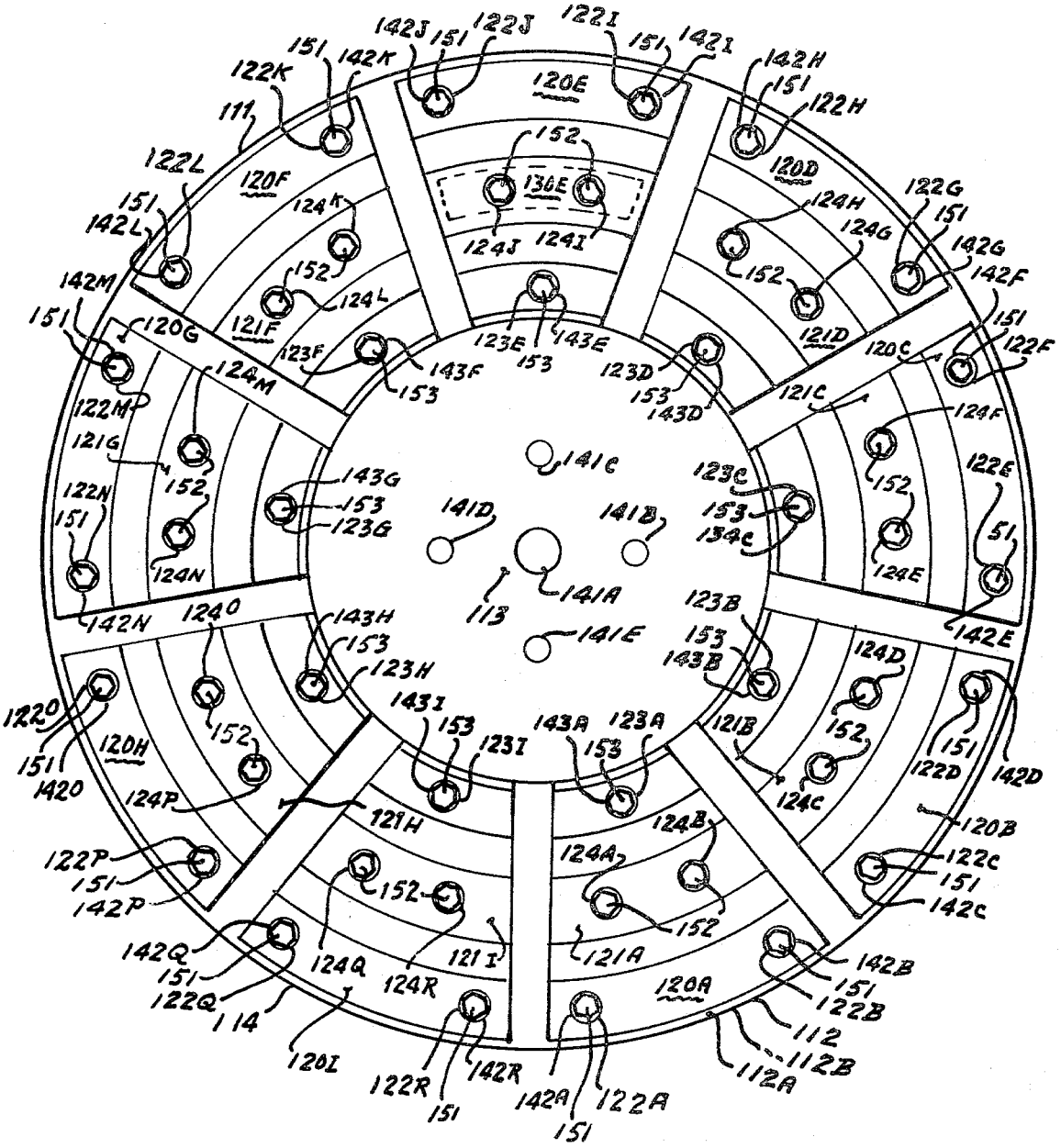
FIG. 3 is a top plan view, in simplified form, partially schematic and partially pictorial, of a variation of the preferred embodiment shown in FIG. 1.
Figure 4:
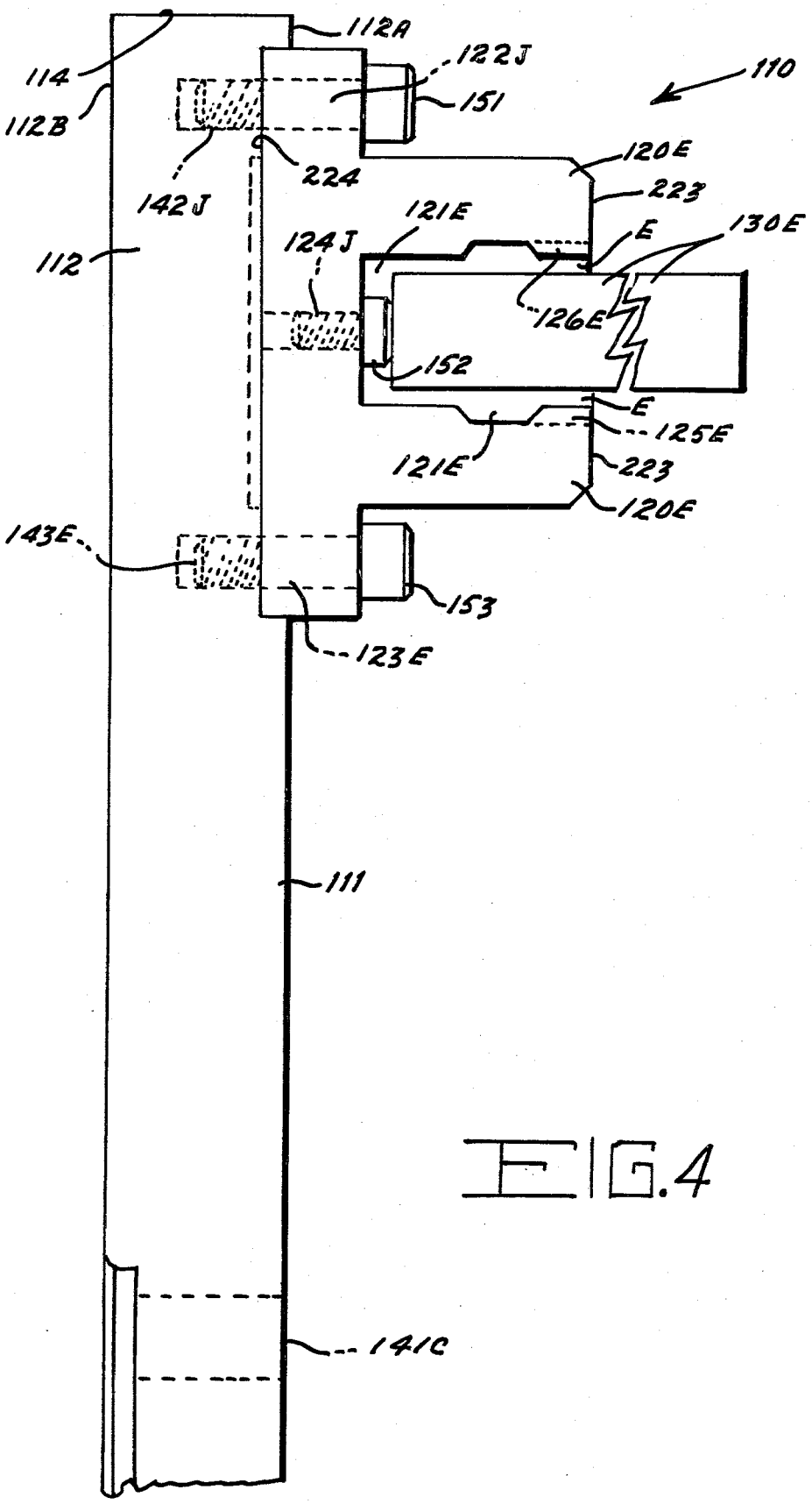
FIG. 4 is a side elevation view, also in simplified form, and also partially schematic and partially pictorial, of one representative portion, partially fragmented, of the variation of the preferred embodiment shown in FIG. 3.

With reference to FIGS. 3 and 4, therein is shown, in simplified form and in two views, a variation 100 of the preferred embodiment 10, shown in FIG. 1 (and a representative portion of which is shown in FIG. 2).

It is to be noted that the variation 100, FIG. 3, like the preferred embodiment 10, FIG. 1, comprises a segmental grinding wheel chuck 111 to which are removably attached a plurality, preferably nine, of replaceable grinding wheel segments, of which only a representative one 130E is shown in the interest of maintaining simplicity of the drawing. As is the situation with regard to the segmental grinding wheel chuck 12 of the preferred embodiment 10, FIG. 1, this chuck 111 comprises: a chuck plate 112, having a first surface 112A, a second surface 112B, a center portion 113, and a perimeter 114; and, a plurality, also preferably nine, of identical arcuate-shaped grinding wheel segment holders 120A–120I, inclusive, releasably connected, preferably in equally-spaced relationship to the first surface 112A of the chuck plate 112, with each of the plurality of grinding wheel segment holders having an arcuate-shaped pocket therein, i.e., 121A–121I, respectively, for holders 120A–120I. As with the preferred embodiment 10, each of the pockets, such as representative one 121E, is limited and defined in part by turned-in edges (or circumferential "grabbers"), such as 125E and 126E for holder 120E. Each of the grinding wheel segments, such as 130E is positioned within its respective pocket, such as 121E, of a different one of the holders, such as 120E; and, is removably attached to its respective holder by and with the use of eutectic material, generally designated "E" in FIGS. 4 and 2.

The chuck plate 112, like chuck plate 12, FIG. 1, has a first plurality of openings, preferably five, such as 141A–141E, and a second plurality of openings, preferably eighteen, such as 142A–142R, and also a third plurality of openings, preferably nine, such as 143A–143E, in the first surface 112A of the chuck plate 112. The location of these three pluralities of openings in and on chuck plate 112, FIG. 3, is the same as the corresponding openings in chuck plate 12, FIG. 1.

The grinding wheel segment holders 120A–120I, like those of the preferred embodiment, have a fourth plurality of openings, preferably eighteen (i.e., two per holder), such as 122A–122R, in and through the holders 120A–120I. However, unlike the holders of the preferred embodiment, these holders, such as representative one 120E, have a fifth plurality of openings, preferably nine, such as 123A–123E, and a sixth plurality of openings, preferably eighteen, 124A–124R, in and through the holders. The fifth plurality of openings 123A–123E are located inward of the fourth plurality 122A–122R, and are in registration with the third plurality of openings 143A–143E in the chuck plate 112. The sixth plurality of openings 124A–124R are located intermediate of the fourth plurality of openings 122A–122R and the fifth plurality of openings 123A–123E.

In the variation 100, the plurality of arcuate-shaped grinding wheel segment holders 120A–120I are releasably connected to the first surface 112A of the chuck plate 112 by means (not numerically referenced, to prevent encumbering the drawing(s) which include: a first plurality of fasteners, each of which is similarly designated 151, passing into and through the fourth plurality of openings 122A–122R in the holders 120A–120I, with these fasteners 151 passing into and accepted by the second plurality of openings 142A–142R in the chuck plate 112; a second plurality of fasteners, each of which is similarly designated 152, passing into and accepted by the sixth plurality of openings 124A–124R in the plurality of holders 120A–120I; and, a third plurality of fasteners, each of which is similarly designated 153, passing into and through the fifth plurality of openings 123A–123I in the holders 120A–120I, with these fasteners 153 also passing into and accepted by the third plurality of openings 143A–143I in the chuck plate 112.

As is the situation with regard to the preferred embodiment 10, FIG. 1, it is preferred, although not necessary, that the chuck plate 112 be in the form of a right circular cylinder, with the first surface 112A and the second surface 112B defining the circular bases of the cylinder, and with the perimeter 114 of the chuck plate 112 simultaneously defining the circumferences of both of these bases (i.e., that are defined by the first and second surfaces 112A and 112B). Also, each of the plurality of arcuate-shaped grinding wheel segment holders 120A–120I has a first surface, such as 223E of holder 120E, and a second surface, such as 224E of holder 120E, with these second surfaces, such as 223E, in abutting contact with first surface 112A of the chuck plate 112.

DESCRIPTION OF THE INVENTIVE METHOD

My inventive method of plunge grinding a workpiece to form annular grooves in the workpiece by using a chuck plate having a plurality of arcuate-shaped grinding wheel segment holders, such as 20A–20I, FIG. 1, and 120A–120I, FIG. 3, wherein each of the segment holders has an arcuate-shaped pocket, such as 21A, FIGS. 1 and 2, and 121E, FIGS. 3 and 4, that is defined and limited in part by turned-in edges (or "grabbers"), such as 25A and 26A, FIG. 2, and 125E and 126E, FIG. 4, and by using a plurality of arcuate-shaped grinding wheel segments, such as 30A–30I, FIG. 1, and representative one 130E, FIGS. 3 and 4, that are shaped complementary to, and are to be removably attached to, the arcuate-shaped pockets of the plurality of arcuate-shaped grinding wheel segment holders, comprises six steps which, in part, have already been inferentially set out above.

The steps are as follows:

Firstly, positioning each one of the plurality of complementarily-shaped and dimensioned grinding wheel segments within the arcuate-shaped pocket of a different one of the plurality of grinding wheel segment holders.

Next, pouring eutectic material (preferably "cerro" metal, such as "Cerrotrue", that is readily available commercially), in a liquid state, into each arcuate-shaped pocket of each grinding wheel segment holder.

Then, hardening (i.e., solidifying) the eutectic material to a solid state, by suitable means, thereby removably attaching the grinding wheel segments to their respective grinding wheel segment holders.

Next, pulse grinding the workpiece to attain the desired annular grooves in the workpiece.

Then, softening (i.e., liquidfying) the hardened eutectic material to a liquid state by suitable means, such as heating.

And, lastly, removing the grinding wheel segments from the grinding wheel segment holders.

MANNER OF OPERATION OF THE PREFERRED EMBODIMENT AND THE VARIATION

The manner of operation, and of use, of the preferred embodiment 10, FIGS. 1 and 2, and of the variation thereof 110, FIGS. 3 and 4, can be easily ascertained by any person of ordinary skill in the art from the foregoing description of the preferred embodiment, the variation, and the method, coupled with reference to the Figures of the drawings.

For others, it is sufficient to say in explanation that, after the grinding wheel segment holders (i.e., 120A–120I, FIG. 3), or the segment holders and the clamps (i.e., 20A–20I, and 60A–60I) are releasably connected to the chuck plate (i.e., 112 or 12, as applicable), and after the grinding wheel segments (such as 130E or 30E–30I as applicable) are removably attached the holders by and with the use of eutectic material, the segmental grinding wheel chuck (i.e., 111 or 11, as applicable), with the grinding wheel segments attached, is mounted to an appropriate conventional fixture for rotating (and otherwise selectively moving) the chuck. Then my inventive apparatus is used to form desired annular grooves in a workpiece, relatively more quickly and with considerable less difficulty, than is otherwise attainable in the art.

It is abundantly clear from all of the foregoing, and from the Figures of the drawings, that the stated objects as well as other related objects, of the invention have been achieved.

It is to be noted that, although there have been described the fundamental and unique features of the invention as applied to a preferred embodiment, a variation thereof, and a method, various other embodiments, variations, adaptations, substitutions, additions, omissions and the like may occur to, and can be made by, those of ordinary skill in the art, without departing from the spirit of the invention.

What is claimed is:

1. The method of plunge grinding a workpiece to form annular grooves therein by using a chuck plate having plurality of arcuate-shaped grinding wheel segment holders releasably connected to said chuck plate, wherein each of said segment holders has an arcuate-shaped pocket therein that is defined and limited in part by turned-in edges, and by using a plurality of arcuate-shaped grinding wheel segments that are dimensioned and shaped complementary to, and are to be removably attached to, said arcuate-shaped pockets of said plurality of arcuate-shaped grinding wheel segment holders, comprising the steps of:

a. positioning each one of a plurality of complementarily-shaped and dimensioned grinding wheel segments within said arcuate-shaped pocket of a different one of said plurality of grinding wheel segment holders;

b. pouring eutectic material, in a liquid state, into each arcuate-shaped pocket of each grinding wheel segment holder;

c. hardening said eutectic material, to a solid state, thereby removably attaching said grinding wheel segments to said grinding wheel segment holders;

d. plunge grinding said workpiece to attain the desired annular grooves in said workpiece;

e. softening said eutectic material to a liquid state;

f. and, removing said grinding wheel segments from said wheel segment holders.

2. An apparatus for plunge grinding, adapted for use in grinding annular grooves into a workpiece, comprising:

a. a segmental grinding wheel chuck further comprising:

(1) a chuck plate having a first surface, a second surface, a center portion, a perimeter, and a first, a second, and a third plurality of openings in said first surface, with said first plurality of openings located at said center portion and passing through said chuck plate and into said said second surface, and with said second plurality of openings located inward of said perimeter, and also with said third plurality of openings located inward of said second plurality of openings, wherein said chuck plate is in the form of a cylinder, with said first and second surfaces of said chuck plate defining bases of said cylinder, and with said perimeter of said chuck plate being in the form of a surface simultaneously defining the circumference of both said first and second surfaces;

(2) and, a plurality of identical arcuate-shaped grinding wheel segment holders releasably connected to said first surface of said chuck plate, wherein each grinding wheel segment holder of said plurality has an arcuate-shaped pocket therein limited and defined in part by turned-in edges, and wherein each said grinding wheel segment holder of said plurality also has a fourth, a fifth, and a sixth plurality of openings therein and therethrough, with said fifth plurality of openings located inward of said fourth plurality of openings, and with said sixth plurality of openings located intermediate of said fourth and of said fifth plurality of openings, and also wherein each said grinding wheel segment holder of said plurality has a first and a second surface, with said second surface thereof abutting with said first surface of said chuck plate, and further wherein said releasable connection of said plurality of grinding wheel segment holders to said first surface of said chuck plate is by a means which includes:

(a) a first plurality of fasteners passing into and through said fourth plurality of openings in said plurality of grinding wheel segment holders, with said fasteners also passing into and accepted by said second plurality of openings in said chuck plate;

(b) a second plurality of fasteners passing into and accepted by said sixth plurality of openings in said plurality of grinding wheel segment holders;

(c) and, a third plurality of fasteners passing into and through said fifth plurality of openings in said plurality of grinding wheel segment holders, with said fasteners also passing into and accepted by said third plurality of openings in said chuck plate;

b. and, a plurality of identical arcuate-shaped grinding wheel segments, with one grinding wheel segment for each one of said plurality of grinding wheel segment holders, and with each one of said plurality of grinding wheel segments positioned within said arcuate-shaped pocket of its respective one of said plurality of grinding wheel segment holders, and removably attached to that grinding wheel segment holder by and with eutectic material.

* * * * *